US010946238B1

(12) United States Patent
Rogus

(10) Patent No.: US 10,946,238 B1
(45) Date of Patent: Mar. 16, 2021

(54) EXERCISE MACHINES HAVING ADJUSTABLE ELLIPTICAL STRIDING MOTION

(71) Applicant: Brunswick Corporation, Mettawa, IL (US)

(72) Inventor: John M. Rogus, Northbrook, IL (US)

(73) Assignee: Life Fitness, LLC, Rosemont, IL (US)

( * ) Notice: Subject to any disclaimer, the term of this patent is extended or adjusted under 35 U.S.C. 154(b) by 123 days.

(21) Appl. No.: 16/042,002

(22) Filed: Jul. 23, 2018

(51) Int. Cl.
*A63B 22/06* (2006.01)
*A63B 22/00* (2006.01)
*A63B 71/06* (2006.01)

(52) U.S. Cl.
CPC ..... *A63B 22/0664* (2013.01); *A63B 22/001* (2013.01); *A63B 22/0015* (2013.01); *A63B 71/0622* (2013.01); *A63B 2022/067* (2013.01)

(58) Field of Classification Search
CPC ..... A63B 2220/20–24; A63B 22/0664; A63B 22/0015–0017; A63B 2022/067–0688; A63B 2022/002; A63B 22/001; A63B 71/0622
See application file for complete search history.

(56) References Cited

U.S. PATENT DOCUMENTS 5,290,211 A * 3/1994 Stearns ..... A63B 21/00178 482/51
5,573,480 A * 11/1996 Rodgers, Jr. ..... A63B 22/001 482/51
5,743,834 A * 4/1998 Rodgers, Jr. ..... A63B 22/001 482/51
5,762,588 A * 6/1998 Chen ..... A63B 22/001 482/57
5,788,610 A * 8/1998 Eschenbach ..... A63B 22/001 482/51
5,899,833 A 5/1999 Ryan et al.
5,947,872 A 9/1999 Ryan et al.
6,007,462 A * 12/1999 Chen ..... A63B 22/001 482/51

(Continued)

FOREIGN PATENT DOCUMENTS

WO WO-2008114291 A1 * 9/2008 ..... A63B 22/0015

OTHER PUBLICATIONS

Hybrid Generator Brake (FB6), Chi Hua Fitness Co., http://www.chihua.com.tw/zh-tw/product, date website visited Jun. 25, 2018.

(Continued)

*Primary Examiner* — Nyca T Nguyen
(74) *Attorney, Agent, or Firm* — Andrus Intellectual Property Law, LLP

(57) ABSTRACT

An exercise machine is for performing a striding exercise motion. The exercise machine has frame; first and second pedal members; first and second foot pads on the first and second pedal members, respectively, each of the first and second foot pads being configured to move in an elliptical path during the striding exercise motion; first and second rocker arms pivotally coupled to the frame; and first and second adjustment devices configured to actively adjust and set a position of the first and second pedal members relative to the first and second rocker arms, respectively, which thereby changes a shape of the elliptical path.

34 Claims, 13 Drawing Sheets

(56) References Cited

U.S. PATENT DOCUMENTS 6,053,847 A * 4/2000 Stearns ..... A63B 22/001 482/51
6,080,086 A * 6/2000 Maresh ..... A63B 22/001 482/51
6,099,439 A 8/2000 Ryan et al.
6,203,474 B1 3/2001 Jones
6,217,486 B1 4/2001 Rosenow
6,248,045 B1 * 6/2001 Stearns ..... A63B 21/068 482/51
6,440,042 B2 * 8/2002 Eschenbach ..... A63B 22/001 482/51
6,450,925 B1 * 9/2002 Kuo ..... A63B 22/001 482/51
6,454,682 B1 * 9/2002 Kuo ..... A63B 22/001 482/52
6,726,600 B2 * 4/2004 Miller ..... A63B 22/001 482/51
6,846,272 B2 1/2005 Rosenow et al.
6,905,442 B1 * 6/2005 Lee ..... A63B 22/001 482/51
6,991,587 B1 1/2006 Eschenbach
7,025,711 B2 4/2006 Eschenbach
7,052,438 B2 5/2006 Eschenbach
7,060,004 B2 * 6/2006 Kuo ..... A63B 22/001 482/51
7,097,592 B2 * 8/2006 Wang ..... A63B 22/001 482/52
7,131,935 B2 * 11/2006 Wang ..... A63B 22/001 482/52
7,169,088 B2 * 1/2007 Rodgers, Jr. ..... A63B 22/001 482/52
7,264,576 B2 * 9/2007 Gerschefske ..... A63B 21/023 482/52
7,270,626 B2 * 9/2007 Porth ..... A63B 22/001 482/52
7,448,986 B1 * 11/2008 Porth ..... A63B 22/001 482/52
7,507,186 B2 * 3/2009 Stearns ..... A63B 22/001 482/52
7,670,268 B1 * 3/2010 Stearns ..... A63B 21/225 482/51
7,918,766 B2 * 4/2011 Lu ..... A63B 22/001 482/51
7,931,566 B1 4/2011 Radke et al.
8,272,997 B2 9/2012 Anderson et al.
8,376,913 B2 * 2/2013 Lee ..... A63B 22/001 482/52
8,419,598 B2 4/2013 Dyer et al.
8,449,437 B1 * 5/2013 Maresh ..... A63B 22/001 482/52
8,827,870 B2 9/2014 Dyer et al.
9,039,577 B2 * 5/2015 Peng ..... A63B 22/001 482/52
9,050,498 B2 * 6/2015 Lu ..... A63B 21/154
9,126,078 B2 9/2015 Anderson et al.
9,138,614 B2 9/2015 Lu et al.
9,283,425 B2 3/2016 Lu et al.
9,403,585 B2 * 8/2016 Arad ..... B63H 5/15
9,586,085 B2 3/2017 Arnold et al.
9,764,187 B1 * 9/2017 Stearns ..... A63B 21/023
9,925,412 B1 3/2018 Lu
2002/0019298 A1 * 2/2002 Eschenbach ..... A63B 22/001 482/51
2002/0151411 A1 * 10/2002 Stearns ..... A63B 22/001 482/52
2002/0198084 A1 * 12/2002 Stearns ..... A63B 21/068 482/57
2003/0045401 A1 * 3/2003 Watterson ..... A63B 22/001 482/51
2004/0097339 A1 * 5/2004 Moon ..... A63B 22/001 482/52
2004/0209741 A1 * 10/2004 Kuo ..... A63B 22/001 482/52
2005/0181911 A1 * 8/2005 Porth ..... A63B 22/001 482/52
2007/0117683 A1 * 5/2007 Ercanbrack ..... A63B 22/001 482/52
2007/0238582 A1 * 10/2007 Lee ..... A63B 22/001 482/52
2010/0248899 A1 * 9/2010 Bedell ..... A63B 22/001 482/4
2013/0210585 A1 8/2013 Arnold
2014/0309086 A1 * 10/2014 Chuang ..... A63B 22/0664 482/57
2016/0158595 A1 * 6/2016 Dalebout ..... A63B 22/001 482/52
2017/0274244 A1 * 9/2017 Chang ..... A63B 22/0664

OTHER PUBLICATIONS

Unpublished U.S. Appl. No. 15/693,724, filed Sep. 1, 2017.

* cited by examiner

EXERCISE MACHINES HAVING ADJUSTABLE ELLIPTICAL STRIDING MOTION

FIELD

The present invention relates to exercise machines, and particularly to exercise machines that facilitate an elliptical striding motion by a user.

BACKGROUND

The following U.S. Patents are incorporated herein by reference:

U.S. Pat. No. 9,925,412 discloses an exercise device including a linkage assembly that links a driving member to a driven member such that circular rotation of the driving member causes generally equal circular rotation of the driven member. The linkage assembly includes a linking member, a first crank arm that connects the driving member to the linking member such that rotation of the driving member causes motion of the linking member, and a second crank arm that connects the linking member to the driven member such that the motion of the linking member causes rotation of the driven member. At least one additional crank arm connects the linking member at a rotational axis that is laterally offset from a straight line through the first and second crank arm rotational axes.

U.S. Pat. No. 9,283,425 discloses an exercise assembly having a frame and elongated foot pedal members that are each movable along user-defined paths of differing dimensions. Each foot pedal member has a front portion and a rear portion. Footpads are disposed on the rear portion of one of the first and second foot pedal members. Elongated coupler arms have a lower portion and an upper portion that is pivotally connected to the frame. Crank members have a first portion that is pivotally connected to the front portion of one of the first and second foot pedal members and have a second portion that is pivotally connected to the lower portion of one of the first and second coupler arms, such that each crank member is rotatable in a circular path. Elongated rocker arms have a lower portion that is pivotally connected to one of the first and second foot pedal members in between the foot pad and the crank member and have an upper portion that is pivotally connected to the frame.

U.S. Pat. No. 9,138,614 discloses an exercise assembly having elongated first and second rocker arms that pivot with respect to each other in a scissors-like motion about a first pivot axis. A slider has a slider body that slides along a linear axis extending through and perpendicular to the first pivot axis. A linkage pivotally couples the first and second rocker arms to the slider body. Pivoting the first and second rocker arms with respect to each other causes the slider body to slide in a first direction along the linear axis. Opposite pivoting of the first and second rocker arms with respect to each other causes the slider body to slide in an opposite, second direction along the linear axis.

U.S. Pat. Nos. 9,126,078 and 8,272,997 disclose an elliptical step exercise apparatus in which a dynamic link mechanism can be used to vary the stride length of the machine. A control system can also be used to vary stride length as a function of various exercise and operating parameters such as speed and direction as well as varying stride length as a part of a preprogrammed exercise routine such as a hill or interval training program. In addition the control system can use measurements of stride length to optimize operation of the apparatus.

U.S. Pat. No. 7,931,566 discloses an elliptical cross trainer that has a rotating inertial flywheel driven by user-engaged linkage exercising a user. A user-actuated brake engages and stops rotation of the flywheel upon actuation by the user.

U.S. Pat. No. 7,918,766 discloses an exercise apparatus for providing elliptical foot motion that utilizes a first and second rocking links suspended from an upper portion of the apparatus frame permitting at least limited arcuate motion of the lower portions of the links. Foot pedal assemblies are connected to rotating shafts or members located on the lower portion of the links such that the foot pedals will describe a generally elliptical path in response to user foot motion on the pedals.

U.S. Pat. No. 6,846,272 discloses an exercise apparatus having a frame that is adapted for placement on the floor, a pivot axle supported by the frame, a first and second pedal levers, pedals secured to the pedal levers, and arm handles connected for motion with the pedal levers and which can utilize a variety of pedal actuation assemblies for generating elliptical motion of the pedal. The stride length portion of the elliptical motion can be increased automatically as a function of exercise parameters such as speed. In addition, the arm handles can be disconnected manually or automatically from the pedal levers.

U.S. Pat. No. 6,217,486 discloses an exercise apparatus that includes a frame adapted for placement on the floor, a pivot axle supported by the frame, a bent pedal lever, a pedal that is secured to the bent pedal lever and a variety of pedal actuation assemblies. These pedal actuation assemblies include components which cooperate to provide an elliptical path and provide the desired foot flexure and weight distribution on the pedal. Consequently, as the pedal moves in its elliptical path, the angular orientation of the pedal, relative to a fixed, horizontal plane, such as the floor, varies in a manner that simulates a natural heel to toe flexure.

U.S. Pat. Nos. 6,203,474; 6,099,439; and 5,947,872 disclose an exercise apparatus including a frame that is adapted for placement on the floor, a pivot axis supported by the frame, a pedal bar which has first and second ends, a pedal that is secured to the pedal bar, an ellipse generator, and a track. The ellipse generator is secured to both the pivot axis and to the first end of the pedal bar such that the first end of said pedal bar moves in an elliptical path around the pivot axis. The track is secured to the frame and engages the second end of said pedal bar such that the second end moves in a linear reciprocating path as the first end of the pedal bar moves in the elliptical path around said pivot axis. Consequently, the pedal also moves in a generally elliptical path. As the pedal moves in its elliptical path, the angular orientation of the pedal, relative to a fixed, horizontal plane, such as the floor, varies in a manner that simulates a natural heel to toe flexure.

U.S. Pat. No. 5,899,833 discloses an exercise apparatus including a frame, a pivot axis supported by the frame, a pedal lever, a coupler for pivotally coupling a first end of the pedal lever to the pivot axis at a predetermined distance from the pivot axis such that the first end moves in an arcuate pathway around the pivot axis, a guide member supported by the frame and engaging a second end of the pedal lever such that the second end of the pedal lever moves in a reciprocating pathway as the first end of the pedal lever moves in the arcuate pathway, and a pedal having a toe portion and a heel portion, the pedal being pivotally coupled with the second end of the pedal lever such that the toe portion is intermediate the heel portion and the pivot axis and the heel portion is raised above the toe portion when the second end moves in the reciprocating pathway in a direction away from the pivot axis.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain non-limiting examples, an exercise machine is for performing a striding exercise motion. The exercise machine has frame; first and second pedal members; first and second foot pads on the first and second pedal members, respectively, each of the first and second foot pads being configured to move in an elliptical path during the striding exercise motion; first and second rocker arms pivotally coupled to the frame; and first and second adjustment devices configured to actively adjust and set a position of the first and second pedal members relative to the first and second rocker arms, respectively, which thereby changes a shape of the elliptical path. In certain non-limiting examples, first and second crank arms are pivotally coupled to a rear frame portion. First and second rear link arms pivotally couple rear pedal portions to the first and second crank arms, respectively, and thereby facilitate adjustment of the first and second pedal members relative to the first and second crank arms when the position of the first and second pedal members relative to the first and second rocker arms is adjusted.

BRIEF DESCRIPTION OF THE DRAWINGS

The present disclosure is described with reference to the following Figures. The same numbers are used throughout the Figures to reference like features and like components. Unless otherwise specifically noted, articles depicted in the drawings are not necessarily drawn to scale.

DETAILED DESCRIPTION OF THE DRAWINGS

Figure 1:
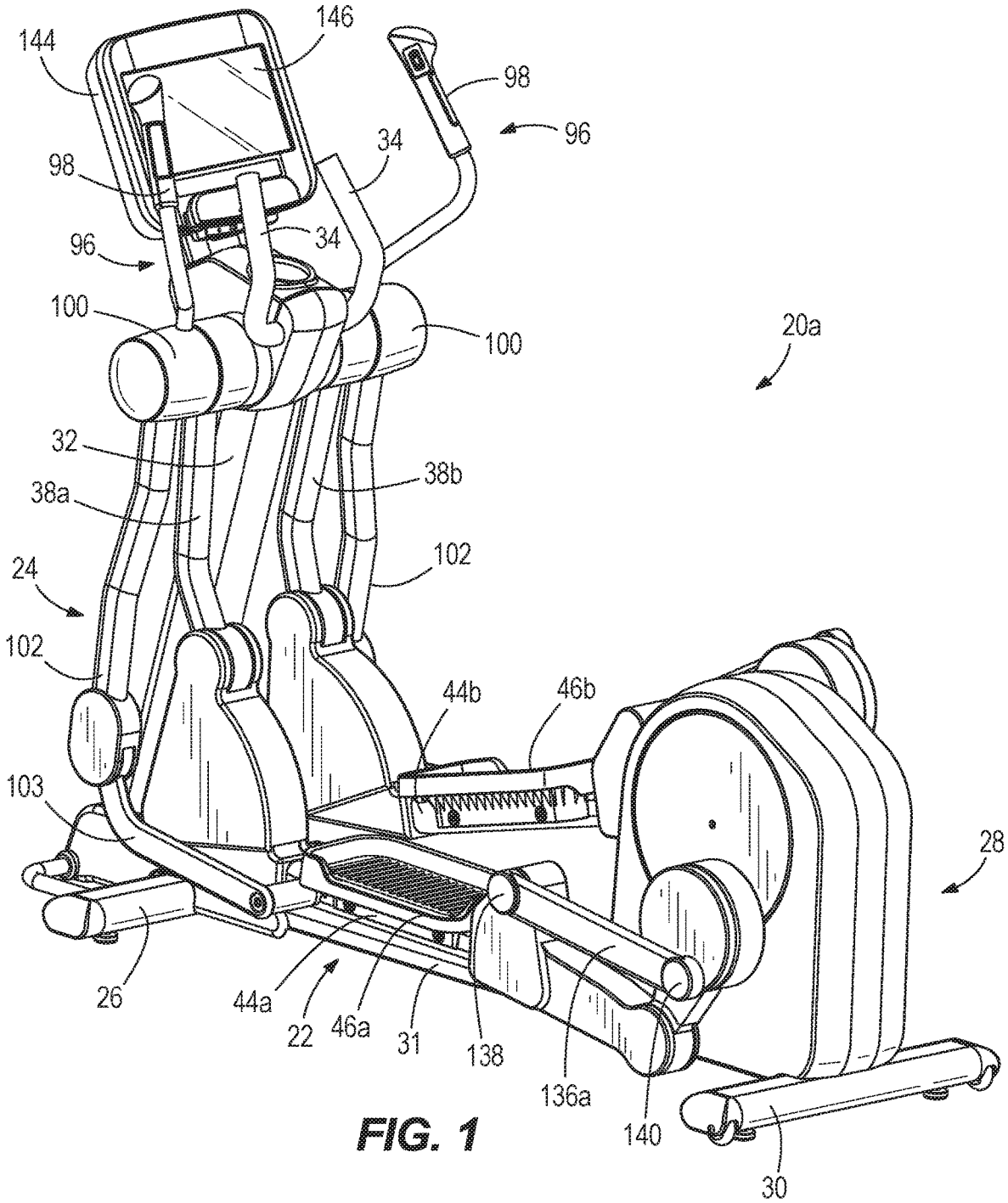
FIG. 1 is a perspective view of a first embodiment of an exercise machine according to the present disclosure.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

During research and development, the present inventor determined that it would be desirable to provide an exercise machine for performing an elliptical striding motion, wherein the user's foot path and/or orientation of the elliptical path traveled by the machine can be adjusted and set based upon the user's preferences and/or based upon a certain exercise routine. The present inventor further determined that it would be desirable to provide such an exercise machine with a robust design that avoids use of tracks or linear rollers/guides, which can be noisy and expensive, and subject to breakdown. The present inventor had determined it would be desirable to design such a machine with a small footprint compared to prior art machines. The present disclosure is a result of these endeavors.

FIG. 1 depicts a first embodiment of an exercise machine 20*a* for performing a striding exercise motion. The exercise machine 20*a* includes a frame 22 having a front frame portion 24 with laterally extending leg braces 26 and a rear frame portion 28 with laterally extending leg braces 30. A base member 31 longitudinally extends from the front frame portion 24 to the rear frame portion 28. A support column 32 vertically upwardly extends from the front frame portion 24 and supports stationary handles 34 for manually grasping by a user performing the striding exercise motion. A stationary shaft 36 (see FIG. 6) laterally extends from the support column 32 at a location proximate to the stationary handles 34. The type and configuration of the frame 22 and stationary handles 34 is merely exemplary and can vary from what is shown.

Figure 2:
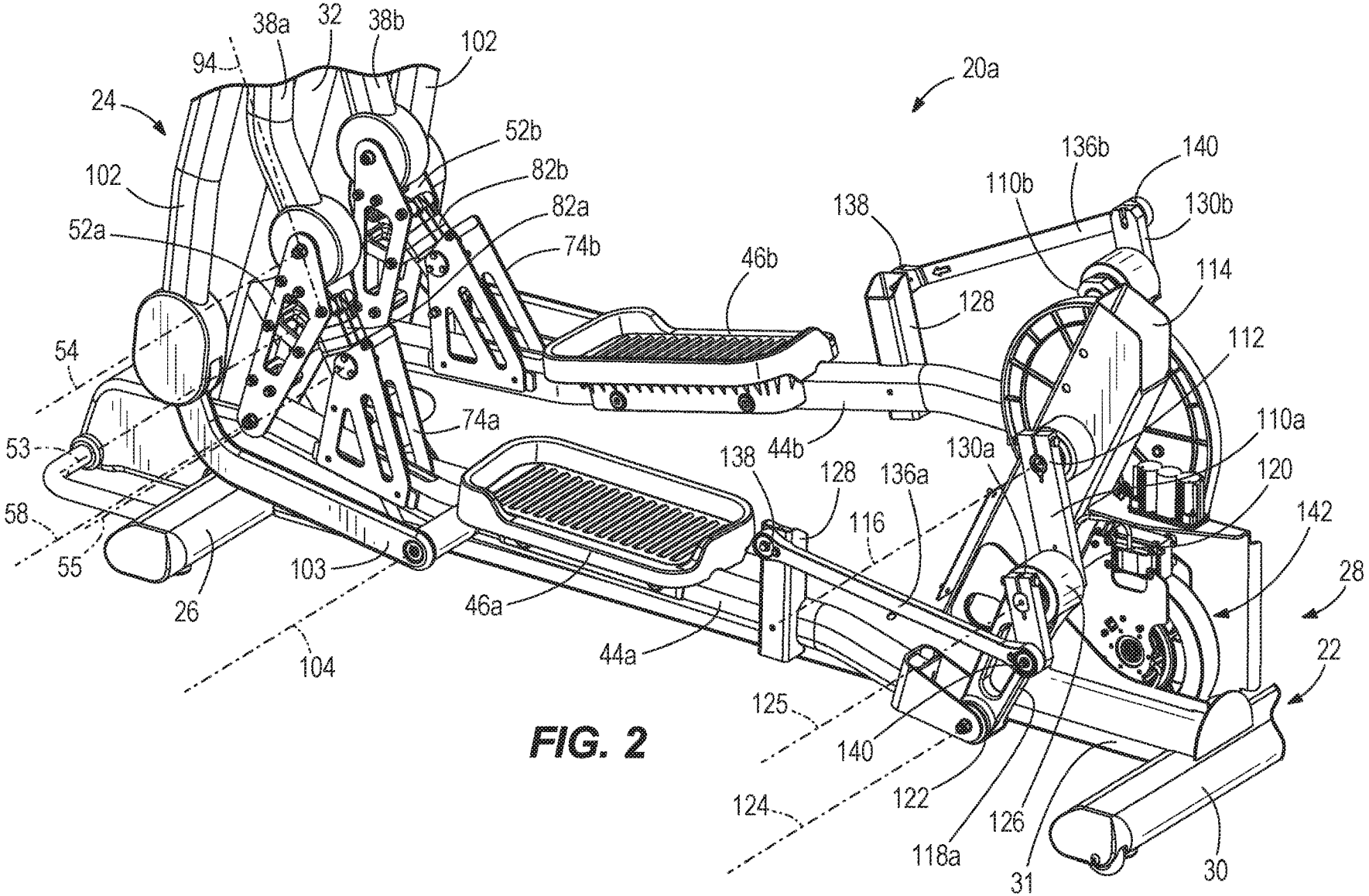
FIG. 2 is a perspective view of a lower portion of the first embodiment having outer shrouds removed.

Referring to FIGS. 1 and 2, first and second rocker arms 38*a*, 38*b* have upper ends that are attached to and pivotally depend from opposite sides of the stationary shaft 36 relative to the support column 32. The upper ends have bearings that are journaled about the stationary shaft 36 and configured so that the rocker arms 38*a*, 38*b* can rotate back and forth with respect to the stationary shaft 36 as the user performs the striding exercise motion. The exercise machine 20*a* further has first and second pedal members 44*a*, 44*b* that longitudinally extend with respect to the frame 22. The pedal members 44*a*, 44*b* support first and second foot pads 46*a*, 46*b* that support the user's feet during the striding exercise motion. The type and configuration of the foot pads 46*a*, 46*b* can vary from what is shown. Examples of suitable foot pads are fully described in commonly-owned U.S. patent application Ser. No. 15/693,724, filed Sep. 1, 2017. In general, the foot pads 46*a*, 46*b* include a tread surface for engagement by the user's feet and a base frame that supports the tread surface with respect to the respective pedal members 44*a*, 44*b*. Generally, as will be further described herein below, the exercise machine 20*a* is configured such that the foot pads 46*a*, 46*b* and the corresponding user's feet move in an elliptical path during the striding exercise motion. The exercise machine 20*a* is further configured so that the user and/or a controller associated with the machine 20*a* can actively vary the shape of the elliptical path, as will be further described with reference to FIGS. 4-6.

Figure 3:
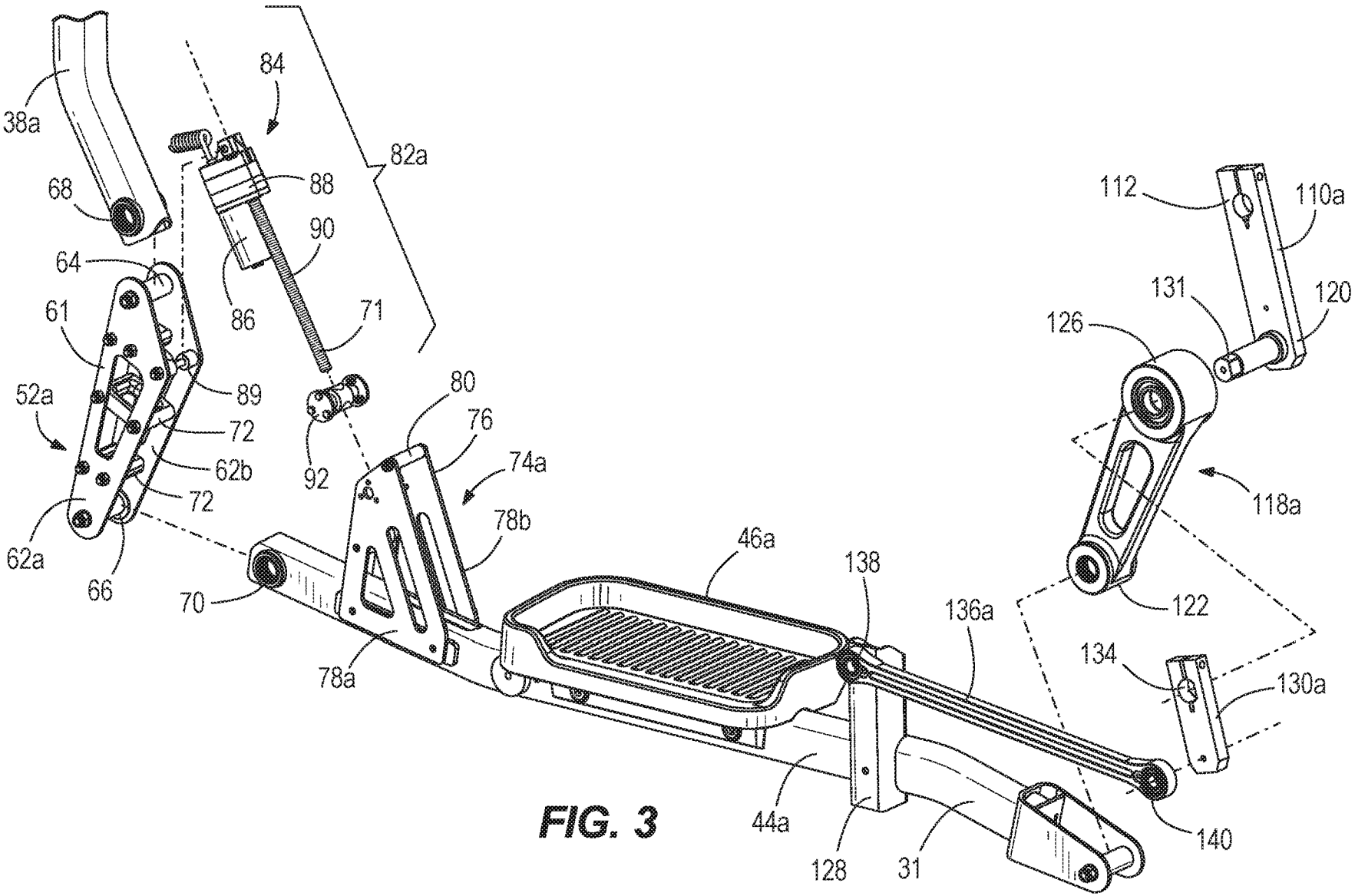
FIG. 3 is an exploded view of portions of the first embodiment.

Referring to FIGS. 2 and 3, first and second front link arms 52*a*, 52*b* are pivotally coupled at a first pivot axis 54 to a lower portion of a respective one of the rocker arms 38*a*, 38*b*, and pivotally coupled at a second pivot axis 58 to a forward portion of a respective one of the pedal members 44*a*, 44*b*. In the illustrated example, the front link arms 52*a*, 52*b* each include a frame member 61 having opposing sides 62*a*, 62*b* and top and bottom pivot pins 64, 66 that extend through cross bores 68, 70 in the respective one of the rocker arms 38*a*, 38*b* and the respective one of the pedal members 44*a*, 44*b*. Additional supporting ribs 72 extend between the opposing sides 62*a*, 62*b* of the frame member 61. The front link arms 52*a*, 52*b* can be a casting, weldment, and/or the like. The configuration of the front link arms 52*a*, 52*b* can vary from what is shown, as will be evident from the description herein below regarding the third embodiment.

With continued reference to FIGS. 2 and 3, first and second supporting brackets 74*a*, 74*b* extend upwardly from the forward portion of the respective pedal members 44*a*, 44*b*. In the illustrated example, the supporting brackets 74*a*, 74*b* each include a frame member 76 having opposing sides 78*a*, 78*b* coupled to the corresponding pedal members 44*a*, 44*b*. A rib 80 extends between the sides 78*a*, 78*b* and provides stability.

With continued reference to FIGS. 2 and 3, first and second adjustment devices 82*a*, 82*b* are specially configured to adjust and set the position of the pedal members 44*a*, 44*b* relative to the rocker arms 38*a*, 38*b*, respectively, which as explained further herein below changes a shape of the above-noted elliptical path. More particularly, the first and second adjustment devices 82*a*, 82*b* are specially configured to adjust and set the position of the first pivot axis 54 relative to the pedal members 44*a*, 44*b*. In the illustrated embodiment, each of the adjustment devices 82*a*, 82*b* includes a linear actuator 84 that is extendable and retractable, which as explained further herein below with reference to FIGS. 4-6 thereby adjusts the relative position of the first and second pivot axes 54, 58. The linear actuator 84 includes a conventional bi-directional electric motor 86 mounted to a gearbox 88. The gearbox 88 is pivotally coupled to a respective front link arm 52*a*, 52*b* at a pivot pin 89 extending between the sides 62*a*, 62*b* of the frame member 61. Thus, each of the adjustment devices 82*a*, 82*b* are coupled to the respective front link arms 52*a*, 52*b* at a respective first adjustment device pivot axis 53 (see FIG. 2). The type and configuration of the linear actuator 84 can vary from what is shown and described. In other examples, the linear actuator 84 could include a worm gear with a right-angle motor.

The gearbox 88 contains a gear set (not shown) that connect an output shaft (not shown) of the electric motor 86 to a first end portion of a positioning screw 90, which is disposed in the gearbox 88. Operation of the electric motor 86 causes rotation of the motor output shaft, which in turn operates the gear set, which in turn causes rotation of the positioning screw 90. A second end portion 71 of the positioning screw 90 is engaged via a threaded engagement with an engagement nut 92 that is pivotally mounted within the respective first or second supporting brackets 74*a*, 74*b*. Thus, each adjustment device 82*a*, 82*b* is coupled to a respective one of the pedal members 44*a*, 44*b* at a second adjustment device pivot axis 55 (see FIG. 2), which is located above and rearwardly of the second pivot axis 58. The adjustment device pivot axes 53, 55 are located vertically between the first and second pivot axes 54, 58. Each of the adjustment devices 82*a*, 82*b* extends along a respective adjustment device axis 94 (see FIG. 2), which in this example exactly and/or nearly intersects with the first pivot axis 54. This can vary from what is shown, as will be evident from description of the second embodiment shown in FIGS. 7-10 hereinafter below.

With continued reference to FIGS. 2 and 3, operation of the electric motor 86 in a first direction causes rotation of the positioning screw 90 about its own axis in a first direction and operation of the electric motor 86 in an opposite direction causes opposite rotation of the positioning screw 90 about its own axis in an opposite, second direction. Rotation of the positioning screw 90 in the first direction causes the positioning screw 90 to travel outwardly relative to the engagement nut 92, thus lengthening the linear actuator 84. Rotation of the positioning screw 90 in the second direction causes the positioning screw 90 to travel further into engagement with the engagement nut 92, thus shortening the linear actuator 84.

Figure 4:
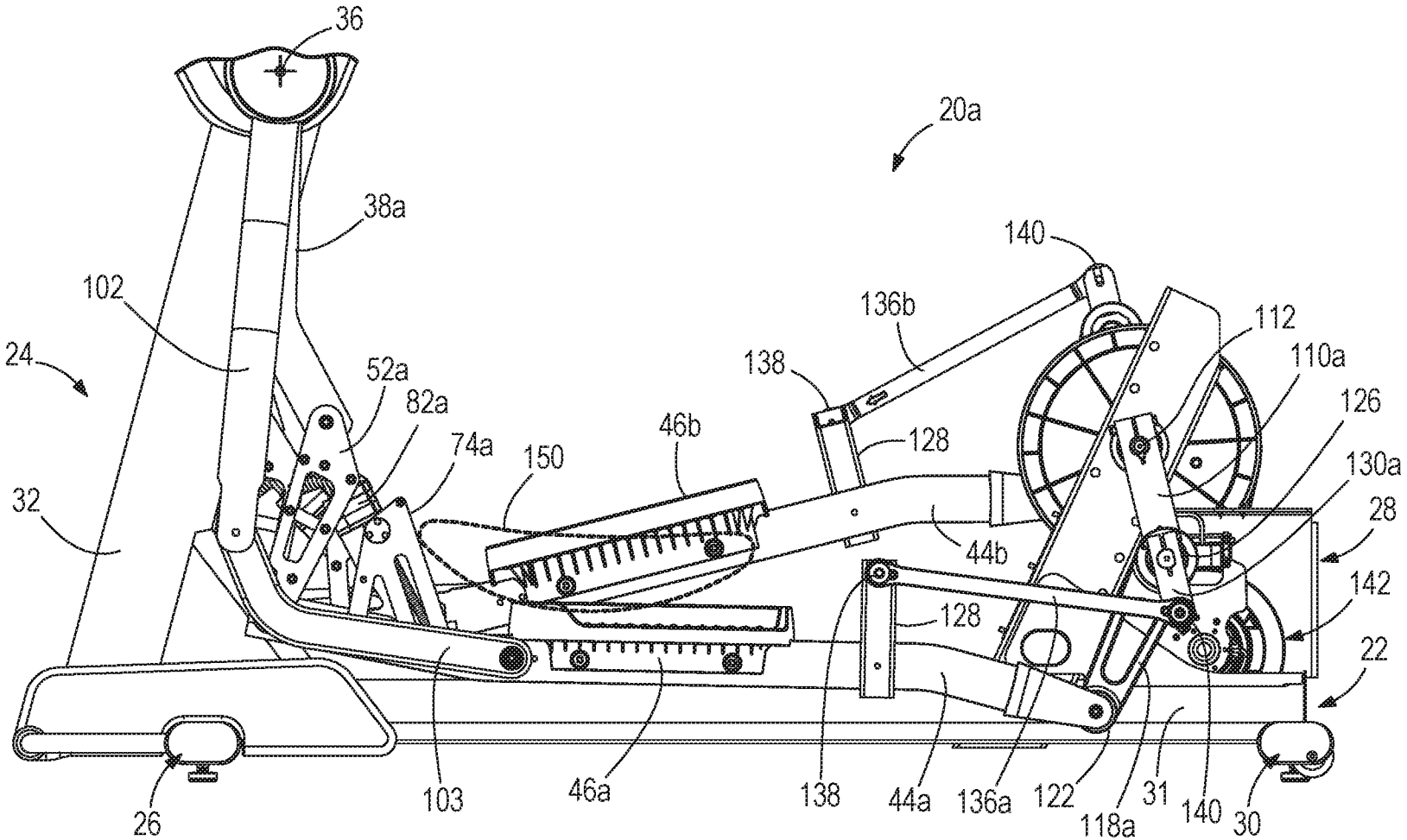
FIG. 4 is a side view of the first embodiment, showing an elliptical path of a foot pad when adjustment devices on the foot pedal members are retracted.
Figure 5:
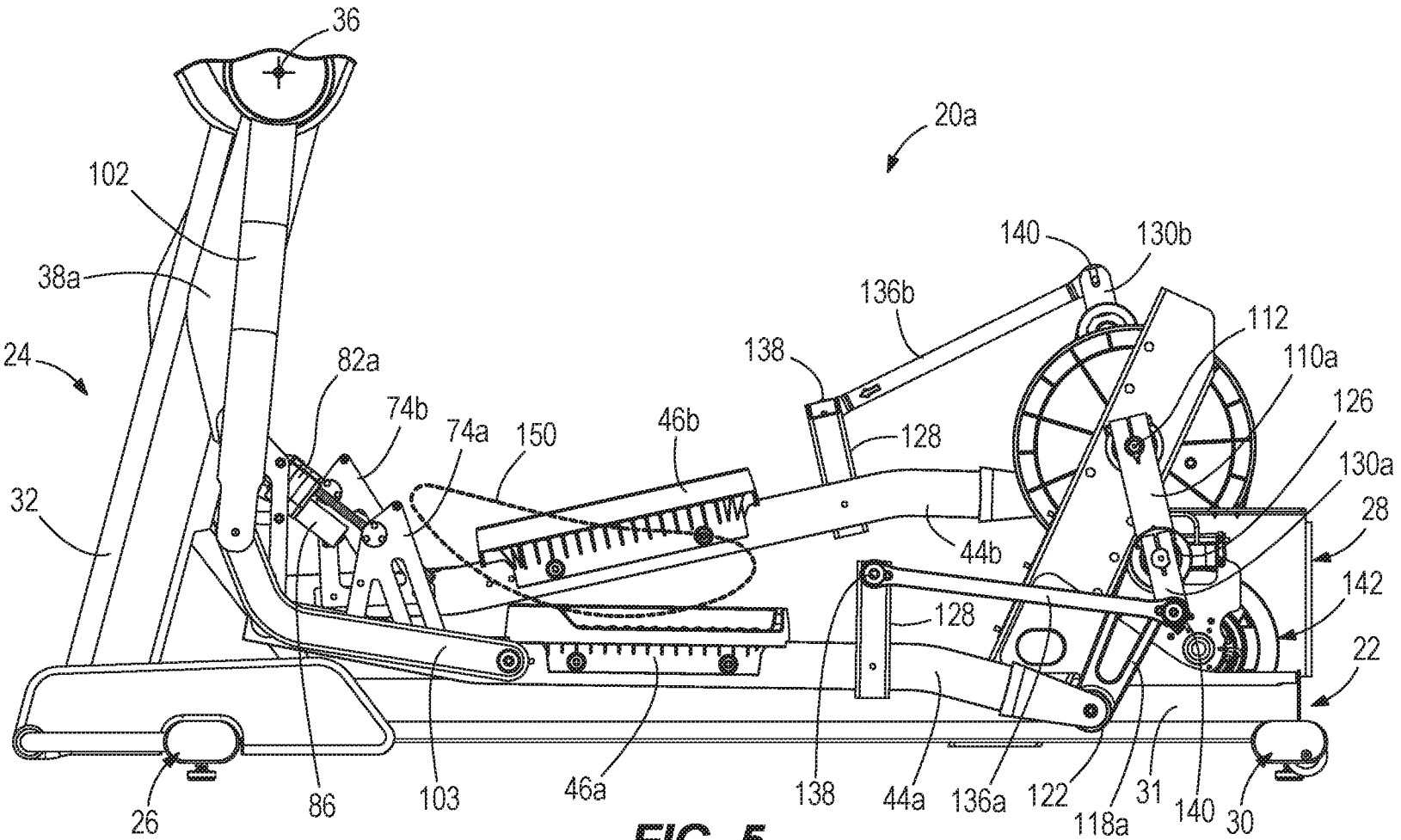
FIG. 5 is a view like FIG. 4, showing the elliptical path when the adjustment devices are partially extended.
Figure 6:
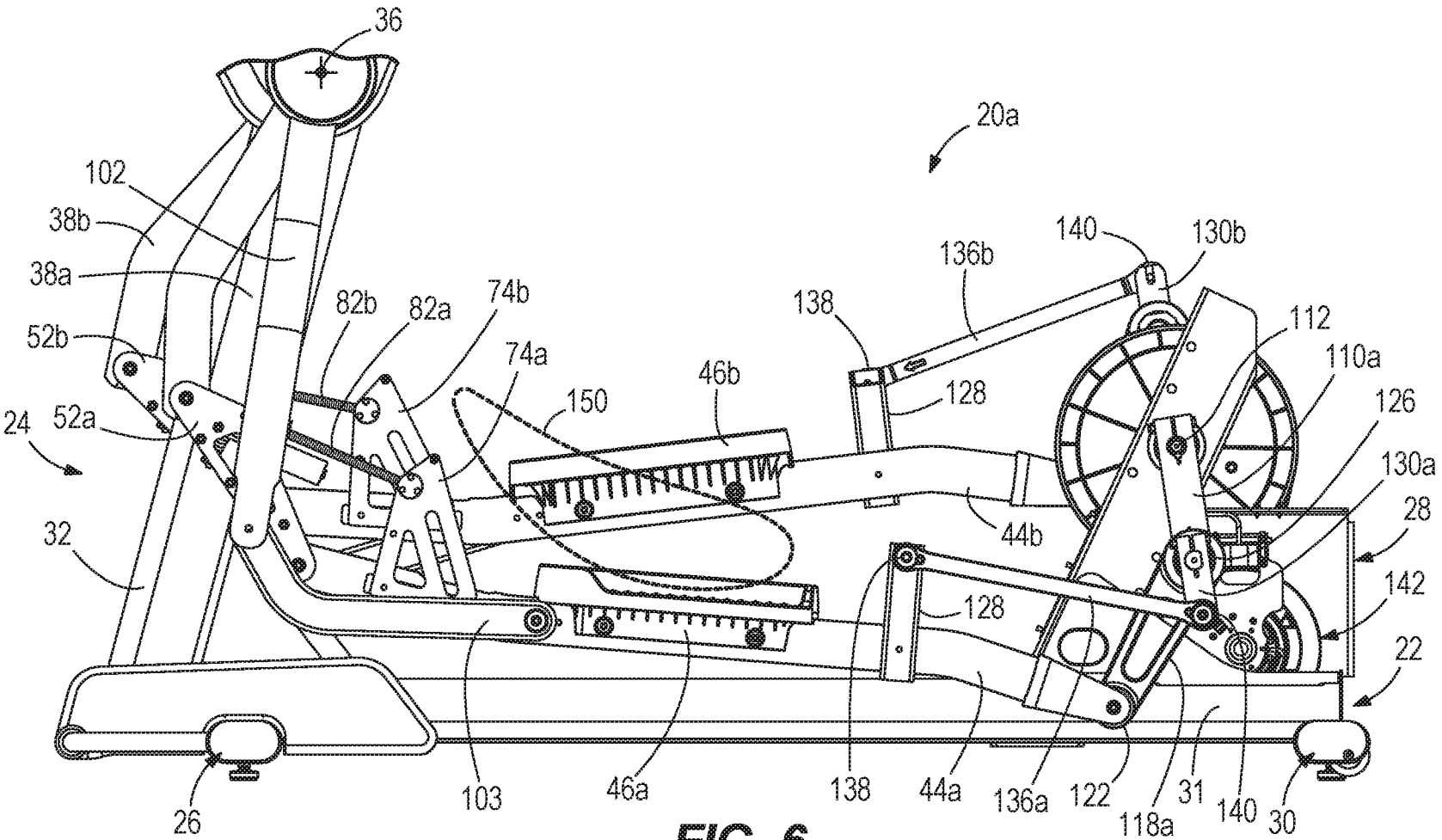
FIG. 6 is a view like FIG. 4, showing the elliptical path when the adjustment devices are fully extended.
Figure 7:
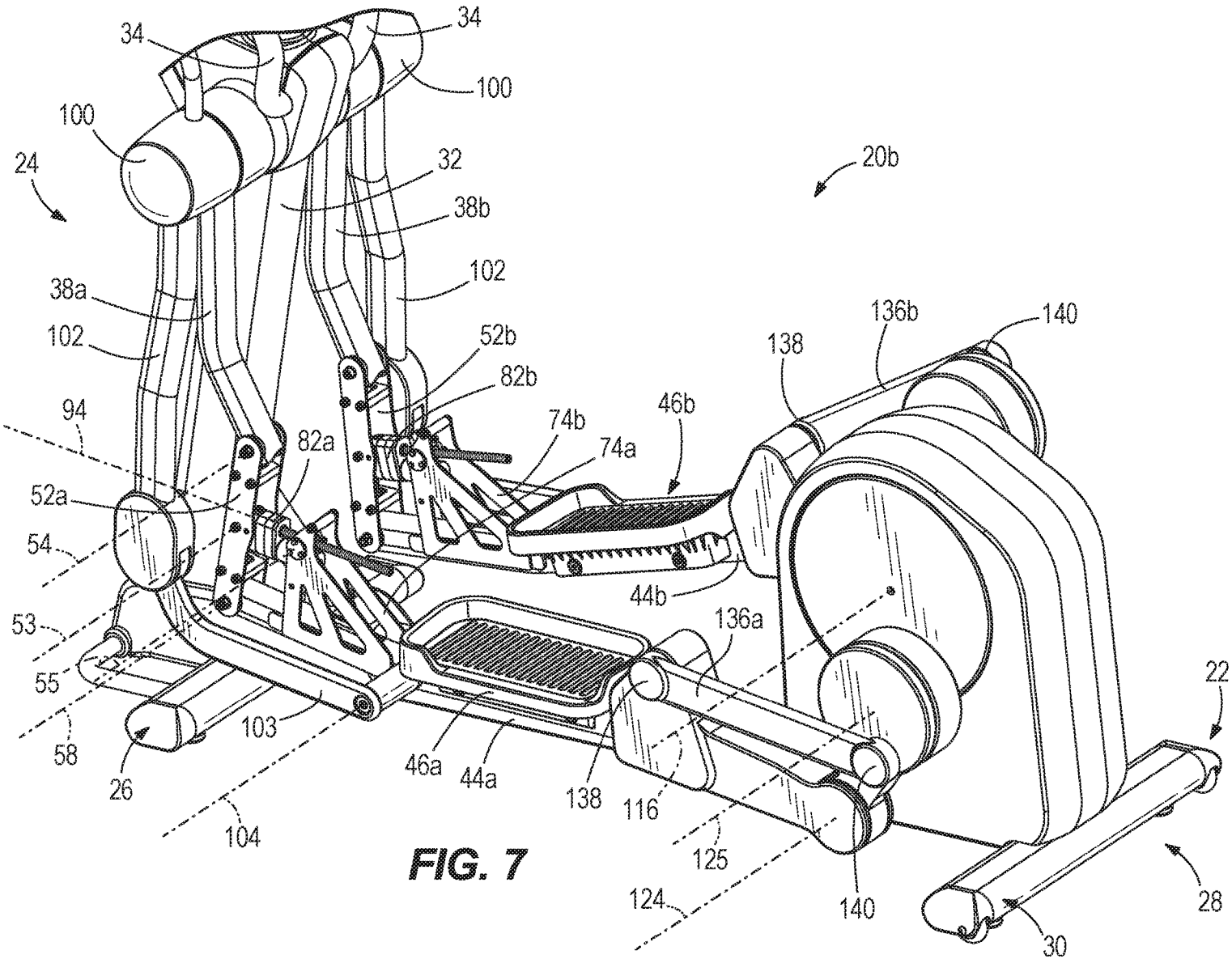
FIG. 7 is a perspective view of a second embodiment of an exercise machine according to the present disclosure.
Figure 8:
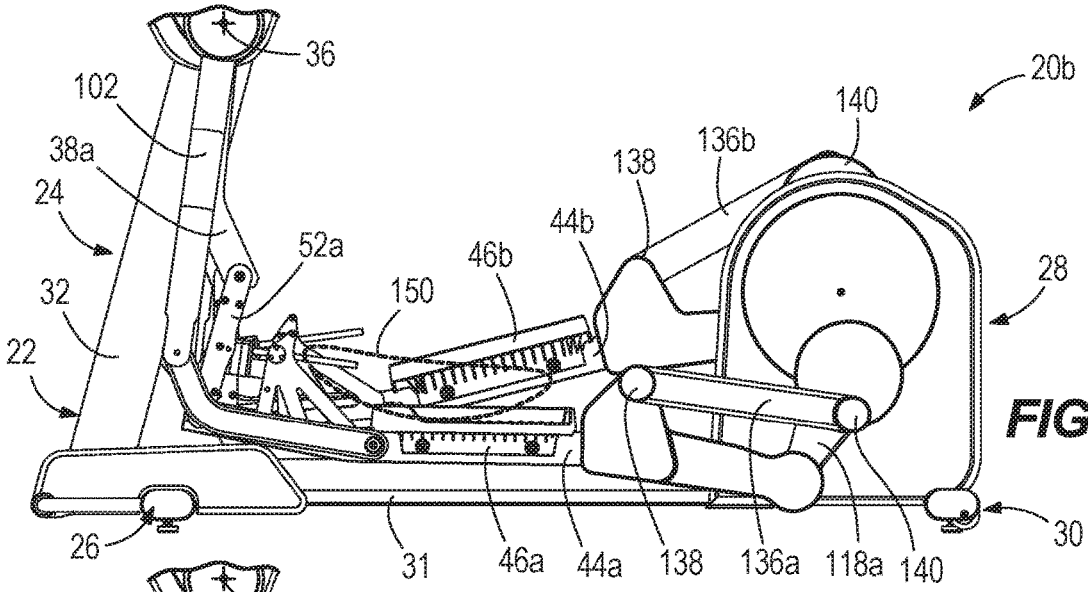
FIG. 8 is a side view of the second embodiment, showing an elliptical path of a foot pad when the adjustment devices on the foot pedal members are retracted.
Figure 9:
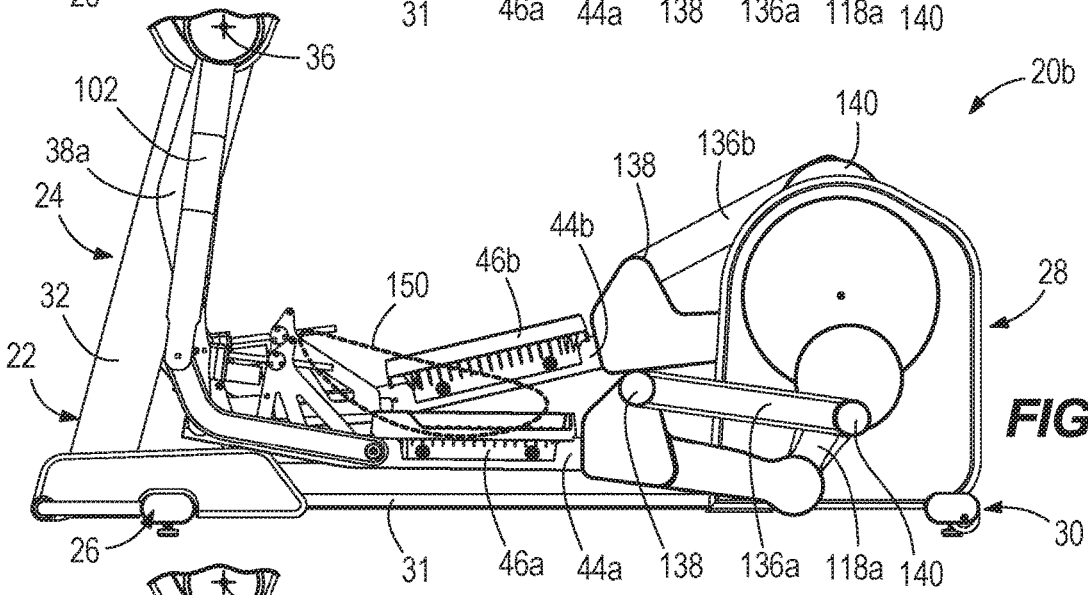
FIG. 9 is a view like FIG. 8, showing the elliptical path when the adjustment devices are partially extended.
Figure 10:
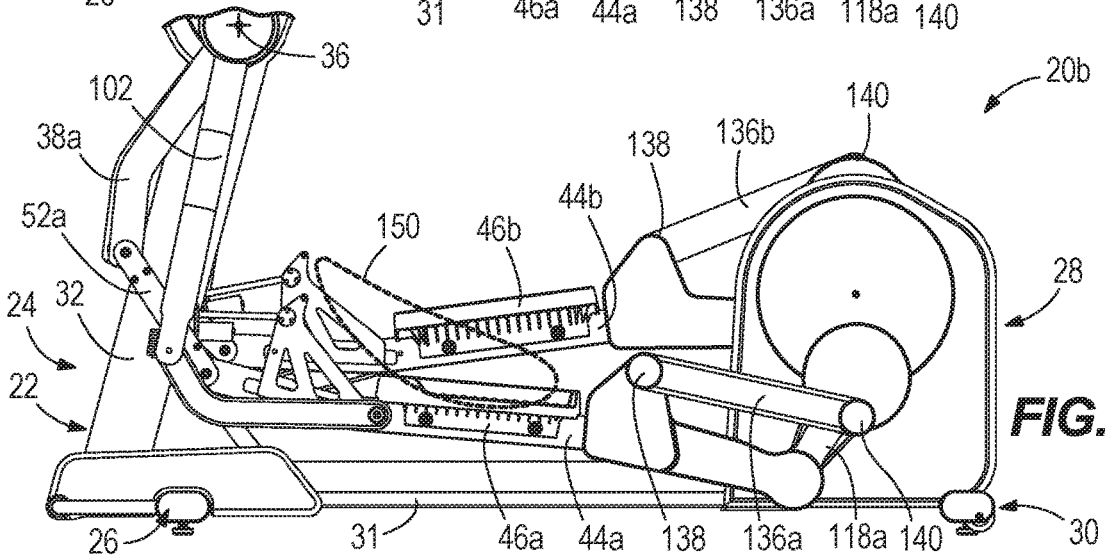
FIG. 10 is a view like FIG. 8, showing the elliptical path when the adjustment devices are fully extended.
Figure 11:
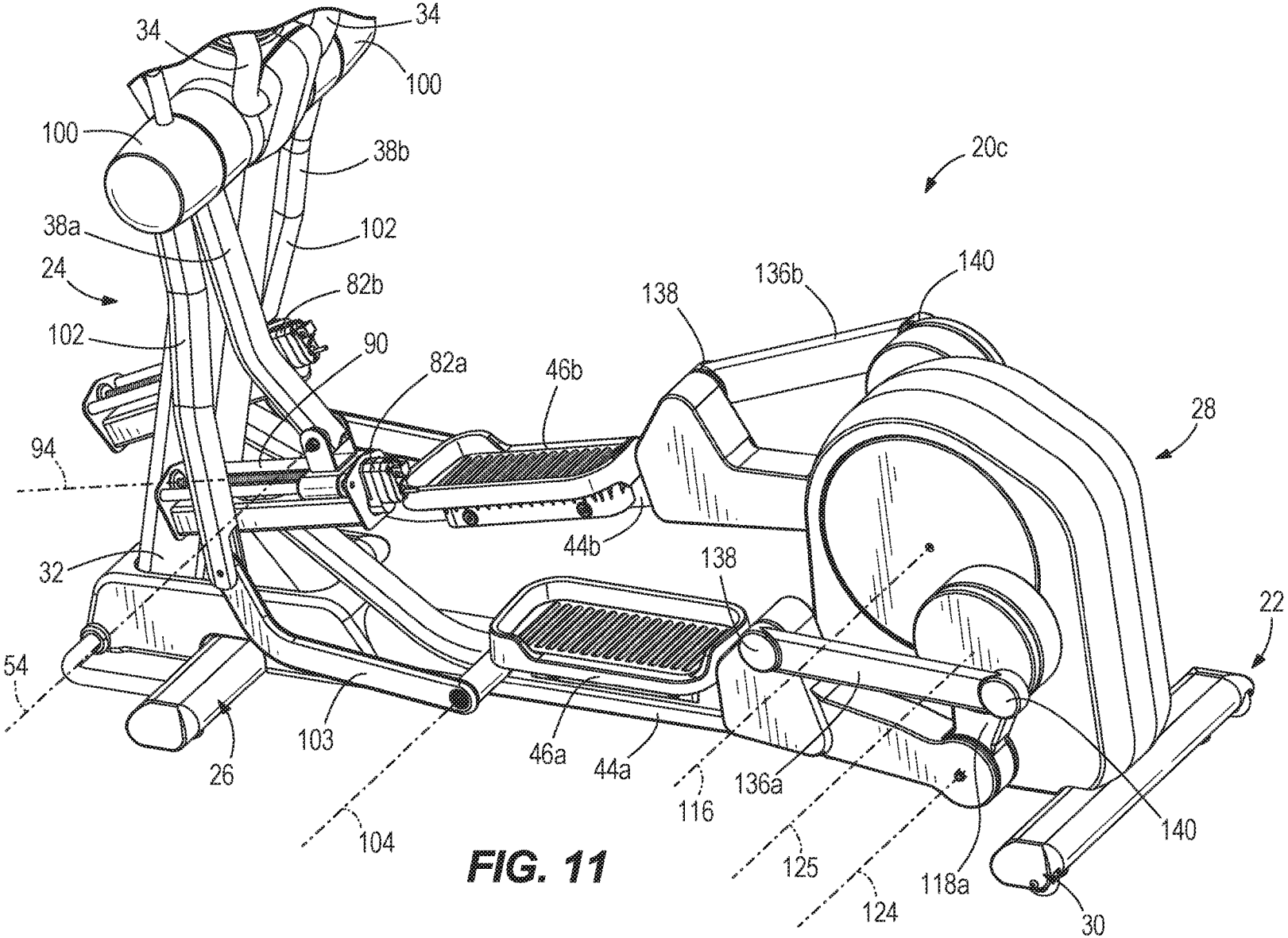
FIG. 11 is a perspective view of a third embodiment of an exercise machine according to the present disclosure.
Figure 12:
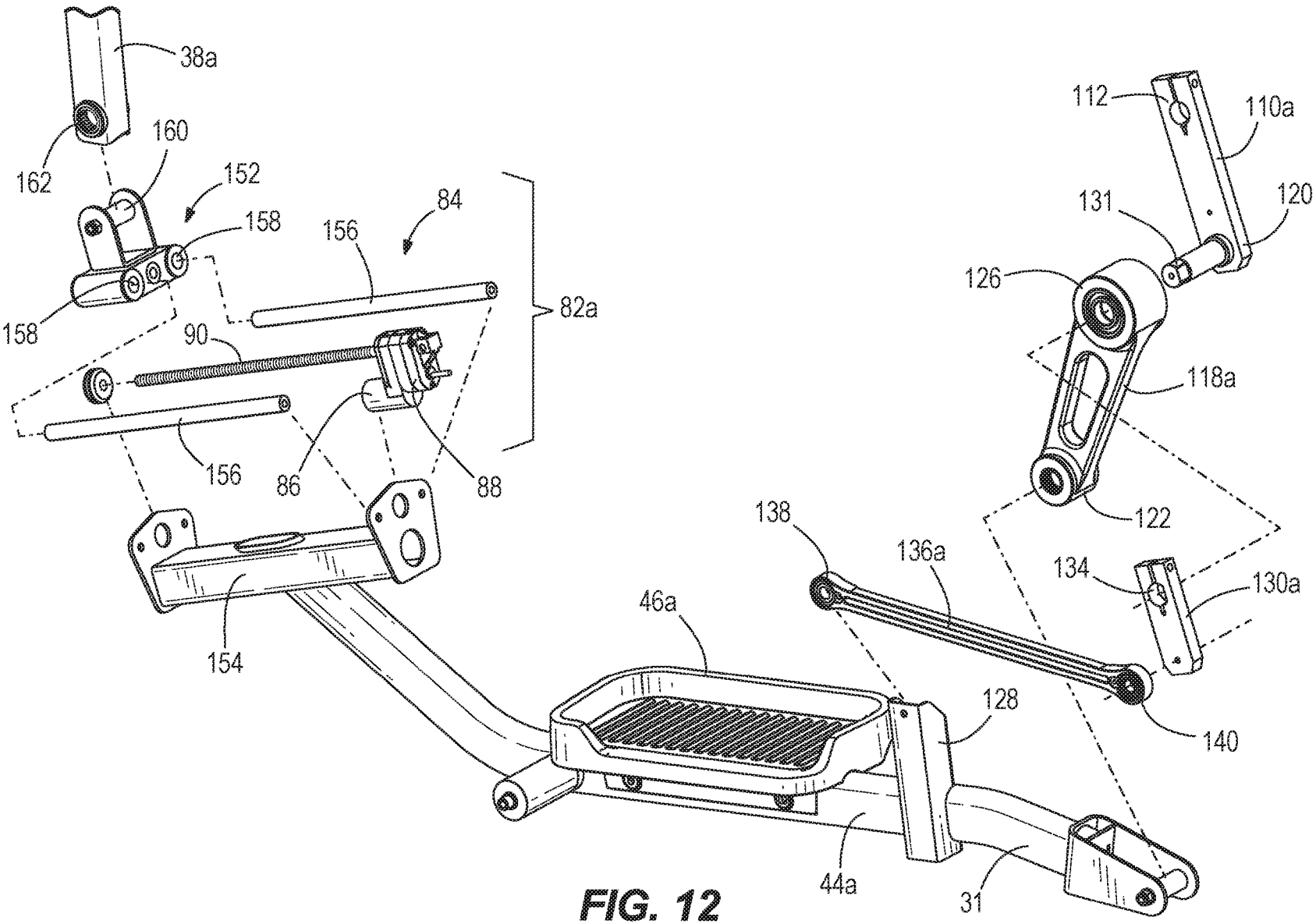
FIG. 12 is an exploded view of portions of the third embodiment.

Referring to FIGS. 1 and 2, the exercise machine 20*a* further includes first and second handle members 96 that are configured for manual engagement during the striding exercise motion. The first and second handle members 96 are pivotally coupled to the frame 22 along the stationary shaft 36 and have upper handle portions 98 that extend upwardly from the stationary shaft 36 from respective pivot bearings 100 journaled on and pivotable about the stationary shaft 36. In this way, the upper handle portions 98 are pivotable forwardly and rearwardly with respect to the stationary shaft 36 during the striding exercise motion. The handle members 96 each have a lower end portion 102 that is pivotally coupled to an L-shaped connecting link 103, which in turn is coupled to a corresponding front portion of one of the pedal members 44*a*, 44*b*, and more specifically along a handle member pivot axis 104 (see FIG. 2) that is located rearwardly of the second pivot axis 58. By coupling to the first and second pedal members 44*a*, 44*b*, the range of motion of the handle members 96 is virtually unaffected by changing the elliptical path 150 (FIGS. 4-6). In other words, adjustment of the position of the pivot axis 54 relative to the respective pedal member 44*a*, 44*b* via the adjustment device 82*a*, 82*b* changes the shape of the ellipse 150, but not the arc or range of motion of the handle members 96. The shape and configuration of the connecting link 103 can vary from what is shown.

Referring now to FIGS. 2, 3, 6, 15 and 16, the rear frame portion 28 supports the rear portions of the respective pedal members 44*a*, 44*b*. Specifically, first and second crank arms 110*a*, 110*b* each have a first end portion 112 that is pivotally coupled to a stanchion 114 that upwardly extends on the rear frame portion 28. The crank arms 110*a*, 110*b* are keyed together so that they remain 180 degrees apart from each other during operation of the exercise machine 20*a*. The first end portions 112 of the crank arms 110*a*, 110*b* are coupled together along a common crank axis 116. First and second rear link arms 118*a*, 118*b* pivotally couple the crank arms 110*a*, 110*b* to the rear portions of the respective pedal members 44*a*, 44*b*. As further explained herein below, the rear link arms 118*a*, 118*b* facilitate adjustment of the pedal members 44*a*, 44*b* relative to the crank arms 110*a*, 110*b* when the position of the pedal members 44*a*, 44*b* relative to the rocker arms 38*a*, 38*b* is adjusted via the adjustment devices 82*a*, 82*b*. The crank arms 110*a*, 110*b* each have a second end portion 120 that is pivotally coupled to a respective one of the rear link arms 118*a*, 118*b*. The rear link arms 118*a*, 118*b* each have a first end portion 122 that is pivotally coupled to the rear portion of the pedal members 44*a*, 44*b* at a pedal-link arm pivot axis 124, and a second end portion 126 that is pivotally coupled to the first and second crank arms 110*a*, 110*b* along a pedal-crank pivot axis 125. In this example, the pedal-link arm pivot axis 124 is located vertically below the common crank axis 116 so that the rear link arms 118*a*, 118*b* are subjected to tension forces from the weight of the user standing on the foot pads 46*a*, 46*b*; however this can vary, as will be evident from the alternate embodiment described herein below with respect to FIGS. 16 and 17.

With continued reference to FIGS. 2, 3, 6, 15 and 16, first and second crank extensions 130*a*, 130*b* axially extend from the second end portions 120 of the crank arms 110*a*, 110*b*, respectively. The crank extensions 130*a*, 130*b* are coupled to the crank arms 110*a*, 110*b* via a keyed shaft 131 on the respective crank arms 110*a*, 110*b* and a corresponding slotted keyhole 134 formed in the crank extensions 130*a*, 130*b*. Thus, the crank extensions 130*a*, 130*b* rotate with and remain parallel with the crank arms 110*a*, 110*b*, as the crank arms 110*a*, 110*b* are rotated about the common crank axis 116.

The rear portions of the pedal members 44*a*, 44*b* each have an upwardly-extending extension member 128 that extends transversely upwardly relative to the respective pedal member 44*a*, 44*b*. First and second guide members 136*a*, 136*b* each have a first guide end portion 138 pivotally coupled to the extension member 128 on a respective rear portion of the respective pedal member 44*a*, 44*b* and a second guide end portion 140 pivotally coupled to a respective one of the crank extensions 130*a*, 130*b*. A conventional resistance mechanism 142 (e.g., hybrid generator-brake) is mounted to the frame 22 at the rear frame portion 28 and coupled to the crank arms 110*a*, 110*b* so as to provide resistance to rotation of the crank arms 110*a*, 110*b* about the common crank axis 116 and optionally generating power based upon the rotation for powering, for example, the electric motor 86. The resistance mechanism 142 is a conventional item and thus is not further described herein for the sake of brevity. A suitable resistance mechanism 142 is the FB 6 Series sold by Chi Hua.

Referring to FIG. 1, the exercise machine 20*a* further includes a controller 144 that is configured to control the adjustment devices 82*a*, 82*b* so as to actively adjust the shape of the elliptical path. Optionally, the controller 144 can be powered by the resistance mechanism 142, and/or a battery, and/or another electric power source. In the illustrated example, the controller 144 is configured to control the electric motor 86 and particularly to cause the electric motor 86 to operate and cause rotation of the positioning screw 90, as described herein above. The controller 144 can include a programmable processor, a memory, and an input/output device. The processor is communicatively connected to a computer readable medium that includes volatile or nonvolatile memory upon which computer readable code is stored. The processor can access the computer readable code on the computer readable medium, and upon executing the code, can send signals to carry out functions according to the methods described herein below. In the illustrated example, execution of the code allows the controller 144 to control (e.g. actuate) the electric motor 86.

The exercise machine 20*a* further includes a user input device 146. Optionally, the user input device 146 can be powered by the resistance mechanism 142, and/or a battery, and/or another electric power source. The type and configuration of the user input device 146 can vary from what is shown. In the illustrated example, the user input device 146 mounted on the frame 22 and vertically extends above the stationary handles 34 so that a user standing on the foot pads 46*a*, 46*b* can view and manually actuate the user input device 146. In this example, the user input device 146 includes a touch screen that displays operating characteristics of the exercise machine 20*a* and allows the user to manually input commands to the controller 144, in particularly to command the controller 144 to actuate the adjustment devices 82*a*, 82*b* via the electric motor 86. This allows the user to actively adjust the shape of the noted elliptical path of travel of the foot pads 46*a*, 46*b*, as further described herein below.

FIGS. 4-6 depict operation of the exercise machine 20*a* in positions of use, in which the adjustment devices 82*a*, 82*b* are retracted (FIG. 4), partially extended (FIG. 5) and fully extended (FIG. 6). In each position, the elliptical path 150 traveled by the foot pads 46*a*, 46*b* has the same horizontal length. As shown in the Figures, the adjustment devices 82*a*, 82*b* advantageously facilitate infinite adjustment of footpath (ellipse) inclination and/or orientation and/or angle. This can be accomplished without the use of ramps or guides. The horizontal length (i.e. the axial length from front to back with respect to the exercise machine 20) of the elliptical path 150 traveled by the foot pads 46*a*, 46*b* remains constant before and after operation of the adjustment devices 82*a*, 82*b*; however in each position of the adjustment devices 82*a*, 82*b*, the shape of the elliptical path 150 is different. In particular, the adjustment devices 82*a*, 82*b* facilitate adjustment and setting of the location of the pedal members 44*a*, 44*b* relative to the rocker arms 38*a*, 38*b*. As these relative positions are changed, so does the vertical displacement of the first pivot axis 54 and second pivot axis 58, which changes shape of the elliptical path 150 along which the foot pads 46*a*, 46*b* move.

As described herein above, the controller 144 can be actuated by the user via the user input device 146 to thereby actively adjust and set the adjustment devices 82*a*, 82*b* to thereby change the shape of the elliptical path 150. Optionally, the controller 144 can also or alternately be programmed to automatically change the elliptical path 150 depending upon an operational or other characteristic of the exercise machine 20*a* and/or an exercise routine saved in the memory of the controller 144. In some examples, changes to the elliptical path 150 can occur before the exercise routine begins. In some examples, changes to the elliptical path 150 can occur during the exercise routine or after the exercise routine ends.

As shown in FIGS. 4-6, actively adjusting the adjustment devices 82*a*, 82*b* actively adjusts and sets a relative position of the first and second pivot axes 54, 58. Stated another way, actively adjusting the adjustment devices 82*a*, 82*b* actively changes an angle at which the front link arms 52*a*, 52*b* extend between the first and second adjustment device pivot axes 53*a*, 53*b*. Changing this angle also causes a change in a fore-aft range of motion through which each of the rocker arms 38*a*, 38*b* pivot with respect to the frame 22 during the striding exercise motion. As described above, adjustment of the position of the pedal members 44*a*, 44*b* relative to the rocker arms 38*a*, 38*b* is facilitated at the rear frame portion 28 by pivoting of the rear link arms 118*a*, 118*b*—without the need for linear guides or other similar bearings. More specifically, the rear link arms 118*a*, 118*b* are pivotally coupled to the pedal members 44*a*, 44*b* and thus adjustment of the position of the pedal members 44*a*, 44*b* is accommodated by pivoting of the rear link arms 118*a*, 118*b* about the respective pedal-link arm axis 124 and pedal-crank pivot axis 125.

FIGS. 7-10 depict a second embodiment of the exercise machine 20*b*, in which the adjustment devices 82*a*, 82*b* each extend along respective adjustment device axis 94 that intersects with the respective front link arm 52*a*, 52*b* between the first and second pivot axes 54, 58. Like reference numbers are applied in accordance with the description herein above regarding the first embodiment. Due to the orientation of the adjustment device axis 94, the second embodiment of the exercise machine 20*b* places more load on the linear actuator 84; however it requires less travel length for the linear actuator 84 to enact a change in the shape of the elliptical path 150 compared to the first embodiment of the exercise machine 20*a*.

Figure 13:
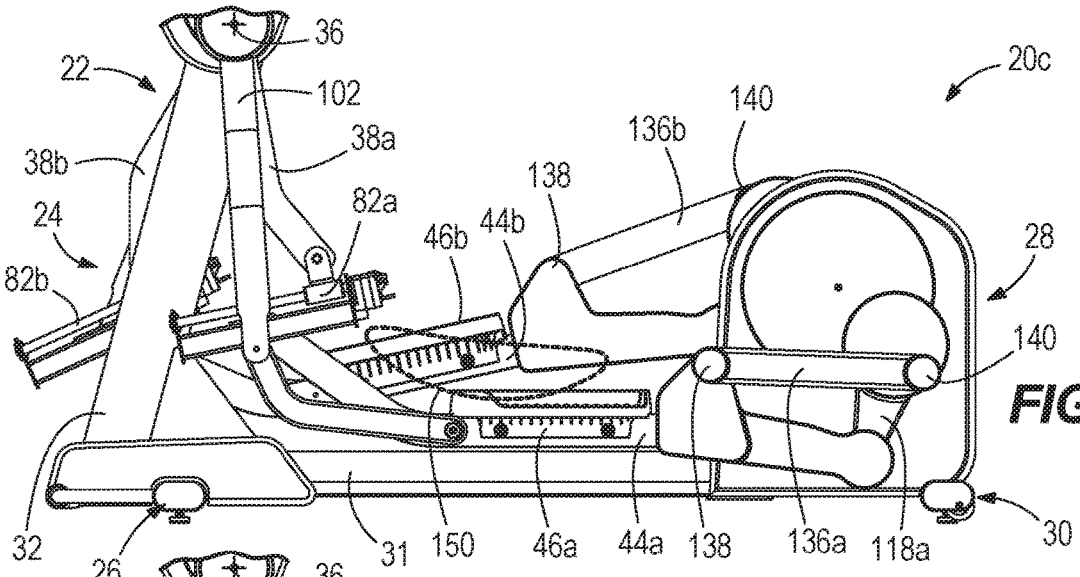
FIG. 13 is a side view of the third embodiment, showing an elliptical path of a foot pad when the adjustment devices on the foot pedal members are retracted.
Figure 14:
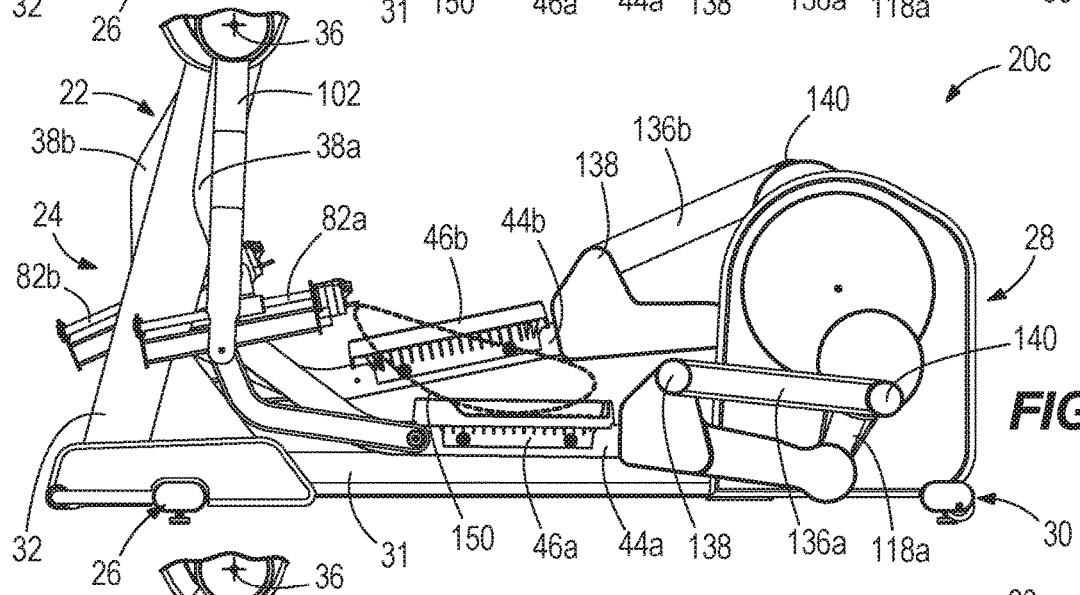
FIG. 14 is a view like FIG. 13, showing the elliptical path when the adjustment devices are partially extended.
Figure 15:
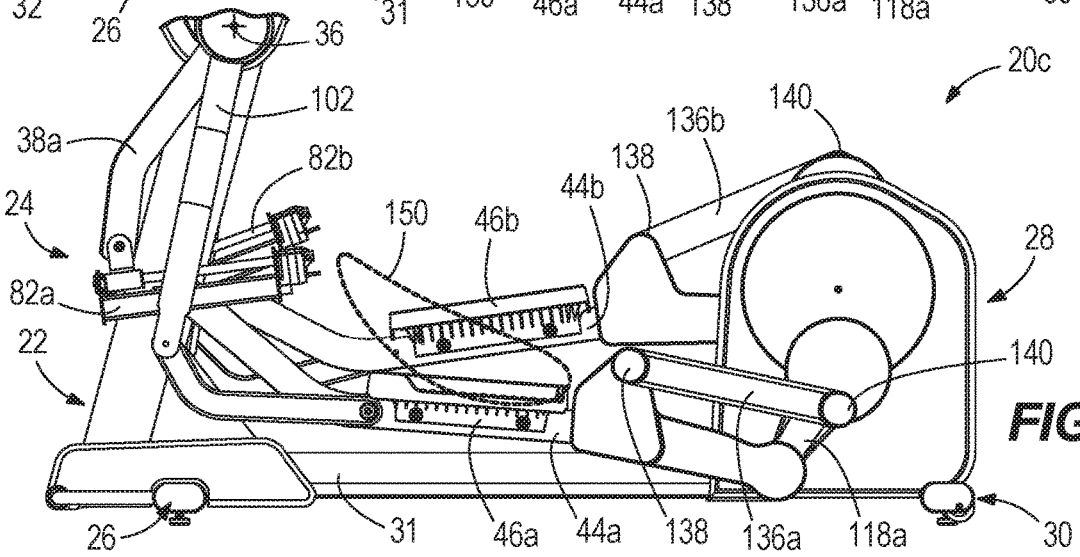
FIG. 15 is a view like FIG. 13, showing the elliptical path when the adjustment devices are fully extended.
Figure 16:
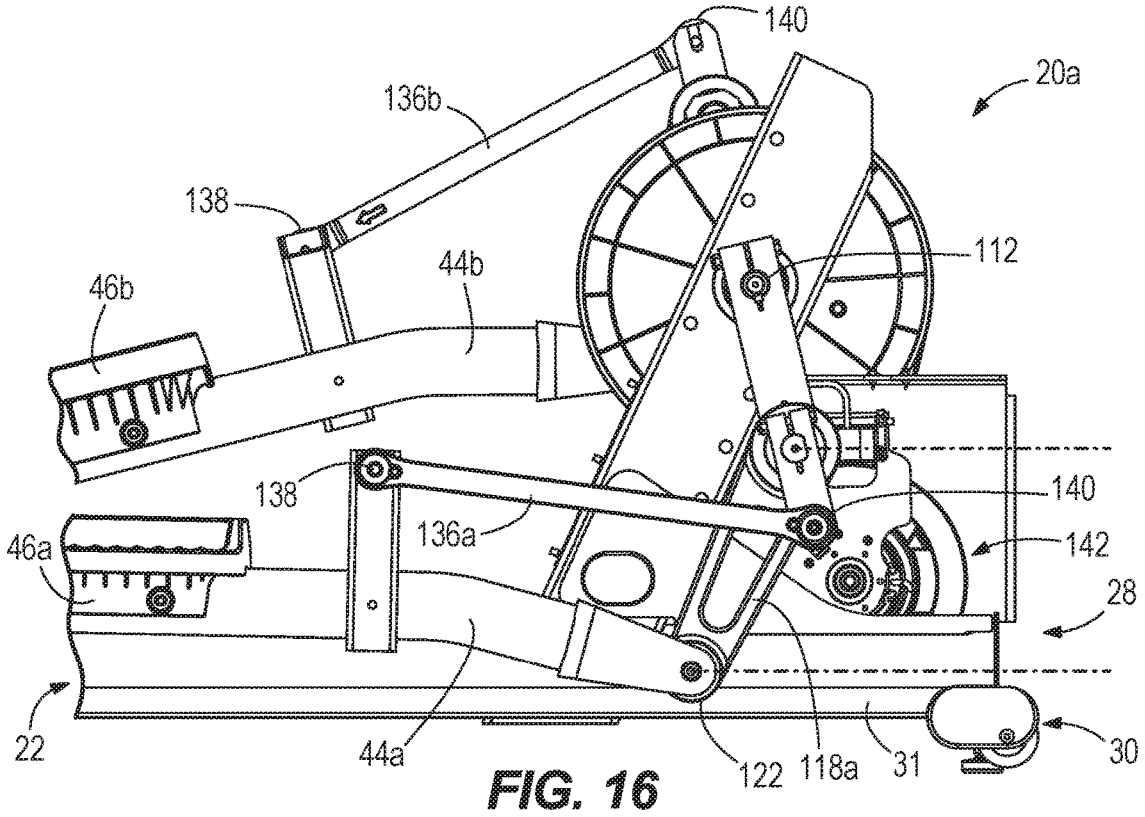
FIG. 16 is a closer view of rear portions of the first, second and third embodiments.

FIGS. 11-14 depict a third embodiment of the exercise machine 20*c*, in which the adjustment devices are pivotally coupled to a respective one of the rocker arms 38*a*, 38*b* and fixedly coupled to a respective one of the pedal members 44*a*, 44*b*. In this example the linear actuator 84 includes a carriage 152 that is pivotally coupled to the respective rocker arm 38*a*, 38*b* and engaged via a threaded connection with the positioning screw 90. Actuation of the linear actuator 84 via actuation of the electric motor 86 causes rotation of the positioning screw 90 (as described herein above) which thereby causes axial movement of the carriage 152 along the positioning screw 90. This adjusts the relative positions of the respective rocker arm 38*a*, 38*b* and pedal member 44*a*, 44*b*, which thereby adjusts the elliptical path 150, as shown in FIGS. 13-15. In the illustrated example, the positioning screw 90 is mounted to a support housing 154 that is fixed to the forward end portion of the respective pedal member 44*a*, 44*b*. The support housing 154 also has smooth stationary shafts 156 that are disposed on opposite sides of the positioning screw 90. The carriage 152 has bearing passages 158 that slide along the smooth stationary shafts 156 as the positioning screw 90 is rotated. The carriage 152 has a pivot pin 160 that is received in a pivot bore 162 through the lower end portion of the respective rocker arm 38*a*, 38*b*. The configuration of the linear actuator 84 can vary from what is shown and described. The configuration of the carriage 152 and support housing 154 can vary from what is shown.

Figure 17:
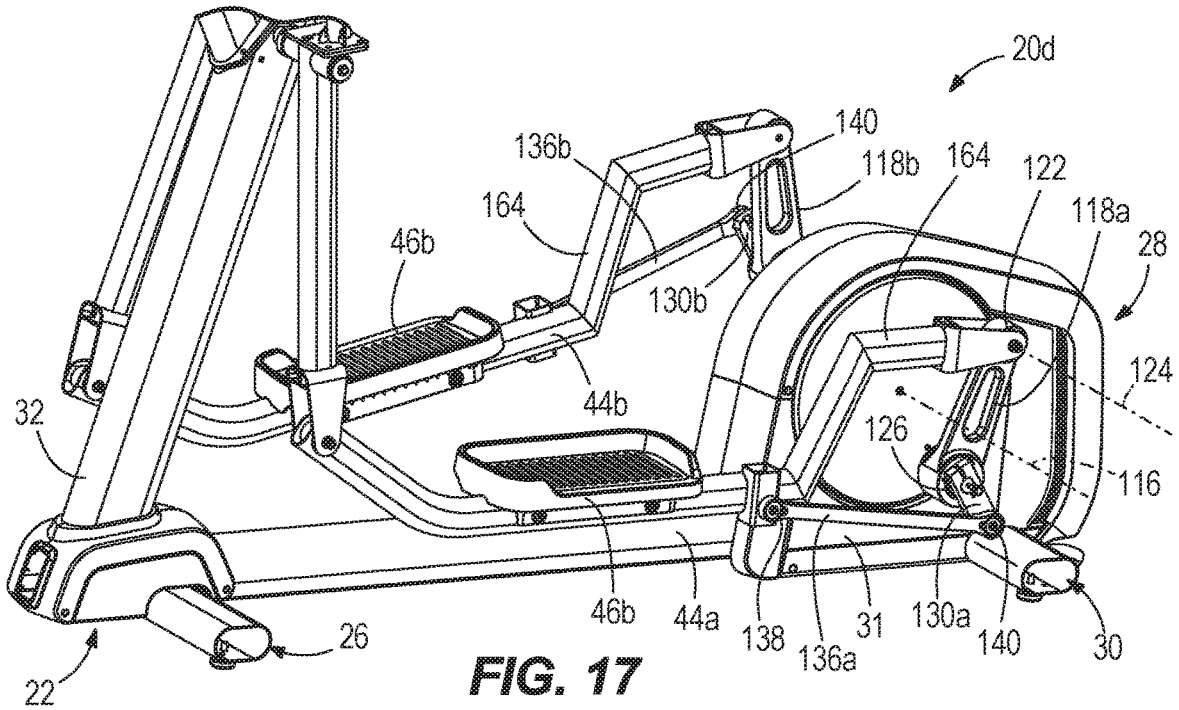
FIG. 17 is a perspective view of a fourth embodiment of an exercise machine according to the present disclosure.
Figure 18:
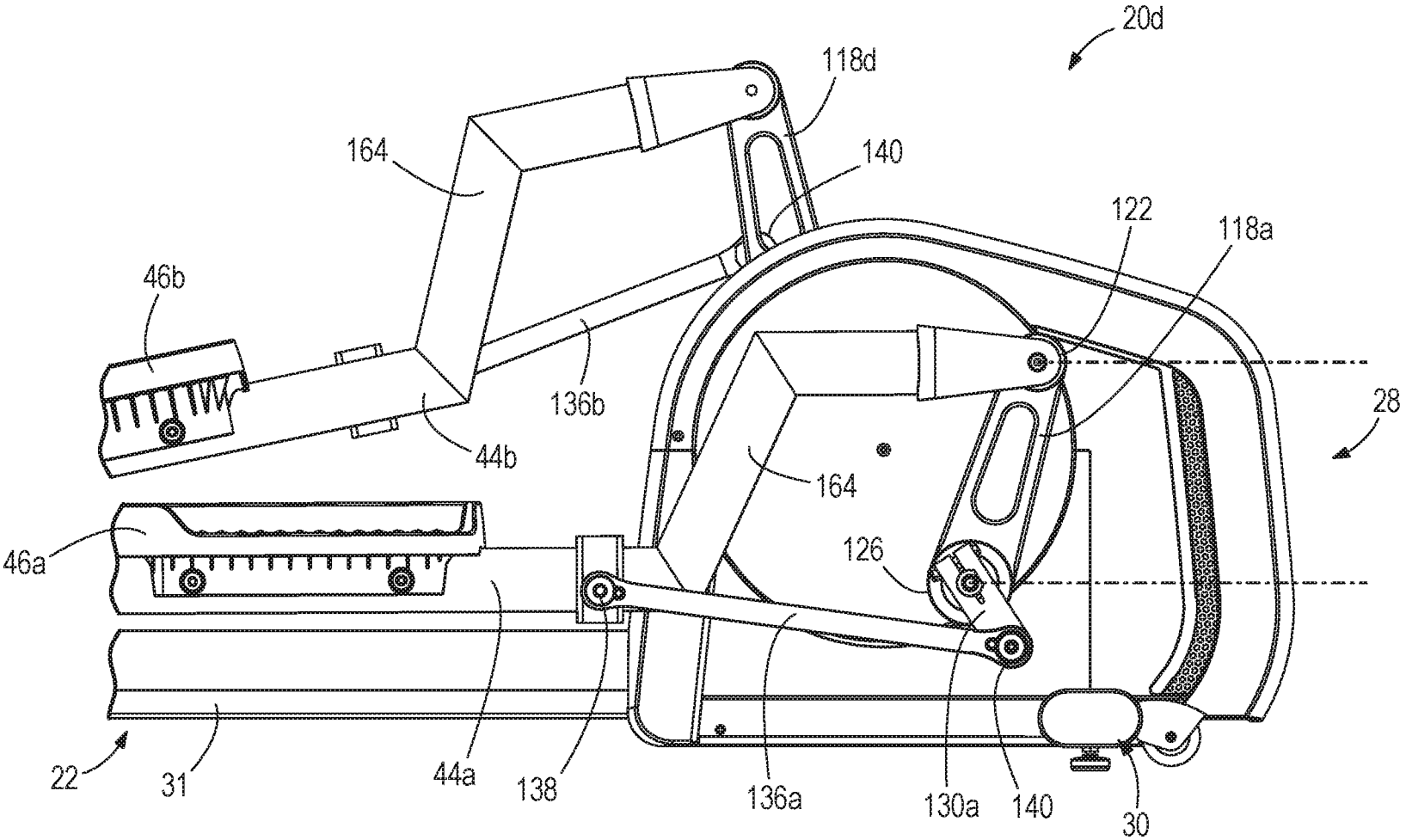
FIG. 18 is a closer view of rear portions of the fourth embodiment.

FIGS. 17 and 18 depict a fourth embodiment of the exercise machine 20*d* wherein the pedal-link arm pivot axis 124 is located vertically higher than the common crank axis 116 in an orientation where the rear link arms 118*a*, 118*b* are subjected to compression forces from the weight of the user. The rear end portion of the pedal member 44*a*, 44*b* includes L-shaped elbow 164 that positions the pedal-link arm axis 124 higher than the common crank axis 116 and this example omits the extension member 128, which is present in the first embodiment and which is replaced by a shorter member or bracket. Contrary to the previous embodiments, the weight of the user standing on the foot pads 46*a*, 46*b* places compression forces on the rear link arms 118*a*, 118*b* rather than tension forces.

Thus it can be seen that examples in the present disclosure facilitate active adjustment of the shape of the elliptical exercise motion without the need for rollers and tracks, or linear bearings and guides, which can require additional maintenance and cause undesirable noise.

Although specific advantages have been enumerated above, various embodiments may include some, none, or all of the enumerated advantages. Other technical advantages may become readily apparent to one of ordinary skill in the art after review of the following figures and description. Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

What is claimed is:

1. An exercise machine for performing a striding exercise motion, the exercise machine comprising:

a frame;

first and second pedal members;

first and second foot pads on the first and second pedal members, respectively, wherein the first and second foot pads are configured to move in respective elliptical paths during the striding exercise motion;

first and second rocker arms pivotally coupled to the frame, wherein the first and second pedal members depend from and pivot along with the first and second rocker arms relative to the frame;

first and second adjustment devices configured to actively adjust and set a position of the first and second pedal members relative to the first and second rocker arms, respectively, which thereby changes a shape of the elliptical paths, respectively; and first and second front link arms that are pivotally coupled at a first pivot axis to a lower portion of a respective one of the first and second rocker arms, and pivotally coupled at a second pivot axis to a forward portion of a respective one of the first and second pedal members;

wherein the first and second adjustment devices are coupled to the respective one of the first and second pedal members and to a respective one of the first and second link arms intermediate the first pivot axis and second pivot axis, and wherein the first and second adjustment devices are configured to actively adjust and set a relative position of the first and second pivot axes on the first and second link arms, respectively, which thereby changes the shapes of the elliptical paths.

2. The exercise machine according to claim 1, wherein the first and second adjustment devices each comprises a linear actuator that is extendable and retractable to adjust the relative position of the first and second pivot axes.

3. The exercise machine according to claim 2, wherein each of the first and second front link arms extends between the first and second pivot axes at an angle, and wherein extension and retraction of the linear actuator changes the angle.

4. The exercise machine according to claim 3, wherein changing the angle changes a fore-aft range of motion through which a respective one of the first and second rocker arm pivots with respect to the frame during the striding exercise motion.

5. The exercise machine according to claim 1, wherein each of the first and second adjustment devices comprises a linear actuator having a first end coupled to a respective one of the first and second front link arms and a second end coupled to a respective one of the first and second pedal members.

6. The exercise machine according to claim 5, wherein each adjustment device extends along an adjustment device axis that intersects the front link arm between the first and second pivot axes.

7. The exercise machine according to claim 5, wherein each adjustment device is coupled to a respective one of the first and second pedal members above and rearwardly of the second pivot axis.

8. The exercise machine according to claim 5, wherein each adjustment device is coupled to a respective one of the first and second pedal members via a supporting bracket that extends upwardly from the forward portion of the respective one of the first and second pedal members.

9. The exercise machine according to claim 1, wherein the frame has a front frame portion and a rear frame portion;

wherein the first and second pedal members each having a front pedal portion, a rear pedal portion, and the foot pad is located between the front and rear pedal portions;

wherein the first and second rocker arms are pivotally coupled to the front frame portion;

wherein the first and second adjustment devices are coupled to the front pedal portions of the first and second pedal members, respectively, and configured to actively adjust and set a position of the first and second pedal members relative to the first and second rocker arms, which thereby changes a shape of the elliptical path;

further comprising first and second crank arms pivotally coupled to the rear frame portion; and further comprising first and second rear link arms that pivotally couple the rear pedal portions to the first and second crank arms, respectively, and thereby facilitate adjustment of the first and second pedal members relative to the first and second crank arms when the position of the first and second pedal members relative to the first and second rocker arms is adjusted, and to facilitate movement of rear pedal portions relative to the first and second crank arms during the striding exercise motion.

10. The exercise machine according to claim 9, wherein the first and second crank arms have a first end portion pivotally coupled to the rear frame portion at a common crank axis and a second end portion pivotally coupled to the first and second rear link arms, respectively, at a crank-link arm pivot axis, and wherein the first and second crank arms both pivot about the common crank axis.

11. The exercise machine according to claim 10, wherein the first and second link arms have a first end portion pivotally coupled to the rear portion of the first and second pedal members, respectively, at a pedal-link arm pivot axis, and a second end portion pivotally coupled at the crank-link arm pivot axis to the first and second crank arms, respectively.

12. The exercise machine according to claim 11, wherein the pedal-link arm pivot axis is located vertically below the common crank axis.

13. The exercise machine according to claim 11, wherein the pedal-link arm pivot axis is located vertically above the common crank axis.

14. The exercise machine according to claim 1, further comprising first and second handle members for manual engagement during the striding exercise motion, wherein the first and second handle members are pivotally coupled to the frame.

15. The exercise machine according to claim 14, wherein the first and second handle members have lower end portions coupled to the first and second foot pedal members, respectively.

16. The exercise machine according to claim 1, further comprising a controller that controls the first and second adjustment devices so as to actively adjust the shape of the elliptical path.

17. The exercise machine according to claim 16, wherein the controller is configured to automatically control the first and second adjustment devices so as to actively adjust the shape of the elliptical path without input from a user.

18. The exercise machine according to 16, wherein the controller is configured to control the first and second adjustment devices before, during and after performance of the striding exercise motion.

19. The exercise machine according to claim 16, further comprising a user input device electronically coupled to the controller, wherein a user can actively adjust the shape of the elliptical path via the user input device.

20. The exercise machine according to claim 1, wherein the shape of the elliptical path has a horizontal length that remains constant.

21. The exercise machine according to claim 1, wherein each of the first and second adjustment devices comprises a linear actuator.

22. The exercise machine according to claim 1, wherein each of the first and second adjustment devices comprises a linear actuator having a motor that rotates a positioning screw with respect to an engagement nut, wherein rotation of the positioning screw in a first direction lengthens the linear actuator and wherein opposite rotation of the positioning screw in a second direction shortens the linear actuator.

23. An exercise machine for performing a striding exercise motion, the exercise machine comprising:

a frame;

first and second pedal members;

first and second foot pads on the first and second pedal members, respectively, each of the first and second foot pads being configured to move in an elliptical path during the striding exercise motion;

first and second rocker arms pivotally coupled to the frame;

first and second adjustment devices configured to actively adjust and set a position of the first and second pedal members relative to the first and second rocker arms, respectively, which thereby changes a shape of the elliptical path; and first and second front link arms that are each pivotally coupled at a first pivot axis to a lower portion of a respective one of the first and second rocker arms, and pivotally coupled at a second pivot axis to a forward portion of a respective one of the first and second pedal members;

wherein each of the first and second adjustment devices comprises a linear actuator having a first end coupled to a respective one of the first and second front link arms and a second end coupled to a respective one of the first and second pedal members; and wherein the first end of each of the first and second adjustment devices is coupled to the respective one of the first and second front link arms at a first adjustment device pivot axis and wherein the second end of each of the first and second adjustment devices is coupled to the respective one of the first and second pedal members at a second adjustment device pivot axis.

24. The exercise machine according to claim 23, wherein the first and second adjustment device pivot axes are located vertically between the first and second pivot axes.

25. An exercise machine for performing a striding exercise motion, the exercise machine comprising:

a frame;

first and second pedal members;

first and second foot pads on the first and second pedal members, respectively, wherein the first and second foot pads are configured to move in respective elliptical paths during the striding exercise motion;

first and second rocker arms pivotally coupled to the frame, wherein the first and second pedal members depend from and pivot along with the first and second rocker arms relative to the frame;

first and second adjustment devices configured to actively adjust and set a position of the first and second pedal members relative to the first and second rocker arms, respectively, which thereby changes a shape of the elliptical paths, respectively, wherein each of the first and second adjustment devices comprises a linear actuator having a first end that is coupled to a respective one of the first and second rocker arms and a second end that is coupled to a respective one of the first and second pedal members.

26. The exercise machine according to claim 25, wherein the first end of the linear actuator is pivotally coupled to the respective one of the first and second rocker arms and wherein the second end of the linear actuator is fixedly coupled to the respective one of the first and second pedal members.

27. The exercise machine according to claim 25, wherein the linear actuator comprises a motor that rotates a positioning screw to thereby cause linear movement of a carriage.

28. The exercise machine according to claim 27, wherein the carriage is coupled to the one of the first and second rocker arms such that rotation of the positioning screw moves the carriage and adjusts the position of the one of the first and second pedal members relative to the one of the first and second rocker arms.

29. The exercise machine according to claim 28, wherein the carriage further comprises a bushing that rides along a support bar positioned parallel to the positioning screw.

30. The exercise machine according to claim 29, wherein the linear actuator is contained within a housing.

31. An exercise machine for performing a striding exercise motion, the exercise machine comprising:

a frame having a front frame portion and a rear frame portion;

first and second pedal members each having a front pedal portion, a rear pedal portion, and a foot pad located between the front and rear pedal portions and being configured to move in an elliptical path during the striding exercise motion;

first and second rocker arms pivotally coupled to the front frame portion;

first and second adjustment devices coupled to the front pedal portions of the first and second pedal members, respectively, and configured to actively adjust and set a position of the first and second pedal members relative to the first and second rocker arms, which thereby changes a shape of the elliptical path;

first and second crank arms pivotally coupled to the rear frame portion;

first and second rear link arms that pivotally couple the rear pedal portions to the first and second crank arms, respectively, and thereby facilitate adjustment of the first and second pedal members relative to the first and second crank arms when the position of the first and second pedal members relative to the first and second rocker arms is adjusted, and to facilitate movement of rear pedal portions relative to the first and second crank arms during the striding exercise motion; and first and second crank extensions that axially extend from the second end portions of the first and second crank arms, respectively, wherein the first and second crank extensions remain parallel to the first and second crank arms as the first and second crank arms pivot with respect to the common crank axis.

32. The exercise machine according to claim 31, further comprising first and second guide members each having a first guide end portion pivotally coupled to the first and second pedal members, respectively, and a second guide end portion pivotally coupled to the first and second crank extensions, respectively.

33. The exercise machine according to claim 32, further comprising first and second pedal extension members extending from the rear pedal portions of the first and second pedal members, respectively, wherein the second guide end portions are pivotally coupled to the first and second crank extension members, respectively.

34. An exercise machine for performing a striding exercise motion, the exercise machine comprising:

a frame;

first and second pedal members;

first and second foot pads on the first and second pedal members, respectively, wherein the first and second foot pads are configured to move in respective elliptical paths during the striding exercise motion;

first and second rocker arms pivotally coupled to the frame, wherein the first and second pedal members depend from and pivot along with the first and second rocker arms relative to the frame;

first and second adjustment devices configured to actively adjust and set a position of the first and second pedal members relative to the first and second rocker arms, respectively, which thereby changes a shape of the elliptical paths, respectively; and a controller configured to actively adjust and set the position of the first and second pedal members relative to the first and second rocker arms, respectively, based upon an input from an operator of the exercise machine wherein each of the first and second adjustment devices comprises a linear actuator having a first end that is coupled to a respective one of the first and second rocker arms and a second end that is coupled to a respective one of the first and second pedal members.

* * * * *